US009205310B1

(12) United States Patent
Hampton

(10) Patent No.: US 9,205,310 B1
(45) Date of Patent: Dec. 8, 2015

(54) PRACTICE BALL

(75) Inventor: Scott Hampton, Elberta, UT (US)

(73) Assignee: Scott Hampton, Santaquin, UT (US)

( * ) Notice: Subject to any disclaimer, the term of this patent is extended or adjusted under 35 U.S.C. 154(b) by 315 days.

(21) Appl. No.: 13/554,233

(22) Filed: Jul. 20, 2012

Related U.S. Application Data

(60) Provisional application No. 61/510,646, filed on Jul. 22, 2011.

(51) Int. Cl.

| | |
|---|---|
| ***A63B 37/12*** | (2006.01) |
| ***A63B 39/00*** | (2006.01) |
| *A63B 45/00* | (2006.01) |
| *A63B 39/06* | (2006.01) |

(52) U.S. Cl.
CPC ..... *A63B 39/00* (2013.01); *A63B 39/06* (2013.01); *A63B 45/00* (2013.01); *A63B 2039/003* (2013.01); *A63B 2243/0004* (2013.01)

(58) Field of Classification Search
CPC .. A63B 39/00; A63B 2039/003; A63B 39/06; A63B 45/00; A63B 2069/0006; A63B 2243/0004; A63B 2243/0008; A63B 2043/001; B29C 41/14
USPC ..... 473/596, 597, 600, 604, 609, 451, 598; 427/157, 158, 208.6, 208.8; 156/278
See application file for complete search history.

(56) References Cited

U.S. PATENT DOCUMENTS

| | | | | | |
|---|---|---|---|---|---|
| 2,645,487 | A * | 7/1953 | Hawes | 473/601 |
| 2,879,179 | A * | 3/1959 | Wiley | 427/430.1 |
| 2,938,237 | A * | 5/1960 | Kern et al. | 264/163 |
| 3,095,261 | A * | 6/1963 | Meyer | 264/263 |
| 4,498,667 | A * | 2/1985 | Tomar | 473/600 |
| 4,729,566 | A * | 3/1988 | Molitor | 473/600 |
| 4,822,041 | A * | 4/1989 | Molitor | 473/597 |
| 5,035,425 | A * | 7/1991 | Edwards | 473/609 |
| 5,091,265 | A * | 2/1992 | Kennedy et al. | 428/690 |
| 5,158,284 | A * | 10/1992 | Vogl | 473/594 |
| 5,639,085 | A * | 6/1997 | Feeney et al. | 473/609 |
| 5,700,211 | A * | 12/1997 | Mackie | 473/613 |
| 5,725,443 | A * | 3/1998 | Sugimoto et al. | 473/378 |
| 5,766,097 | A * | 6/1998 | Horiuchi et al. | 473/365 |
| 6,395,861 | B1 * | 5/2002 | Kennedy, III | 473/600 |
| 6,544,130 | B1 | 4/2003 | Weidenhammer | |
| 6,719,653 | B1 * | 4/2004 | Nesbitt | 473/600 |
| 8,251,846 | B2 * | 8/2012 | Krysiak | 473/604 |
| 2011/0160011 | A1 * | 6/2011 | Wilson | 473/601 |
| 2013/0095963 | A1 * | 4/2013 | Smith | 473/597 |

* cited by examiner

*Primary Examiner* — Steven Wong

(57) ABSTRACT

A practice ball can comprise a coating on a plastic substantially spherical core having a solid continuous outer surface and a hollow interior. Raised laces features can extend from the outer surface of the core. The coating can also disposed on the raised laces features, and a portion of the coating on the raised laces features can extend from an outer surface of the coating on the outer surface of the core.

18 Claims, 3 Drawing Sheets

PRACTICE BALL

CROSS REFERENCE TO RELATED APPLICATION(S)

This application is a non-provisional and claims the benefit of U.S. Provisional Patent Application Ser. No. 61/510,646 (filed Jul. 22, 2012), which is incorporated by reference herein in its entirety.

BACKGROUND

Light weight practice balls, such as plastic wiffle balls, are used for practice in a variety of sports. Because the balls are light weight, the balls typically do not travel or fly in the same manner as an actual ball used in the sport. Embodiments of the invention utilizing a coating to improve the travel and flight characteristics of a light weight a practice ball such as a plastic wiffle ball.

SUMMARY

In some embodiments, a practice ball can comprise a plastic substantially spherical core and a coating. The core can have a solid continuous outer surface and a hollow interior. Raised laces features can extend from the outer surface of the core and be disposed in a continuous pattern that divides the outer surface into two portions. The pattern of the raised laces features can also cross twice a first circumference of the core and four times a second circumference of the cores. The first circumference can be in a first plane, the second circumference can be in a second plane that is perpendicular to said first plane. The coating can be disposed on and cover the outer surface of the core and cam be a different material than the core. The coating can also disposed on the raised laces features, and a portion of the coating on the raised laces features can extend from an outer surface of the coating on the outer surface of the core at least one sixty-fourth of an inch.

In some embodiments, a process of making a practice ball can comprise obtaining a plastic substantially spherical core, which can comprise a solid continuous outer surface, a hollow interior, and raised laces features disposed on and extending from the outer surface. The process can also include applying a uniform coating to the outer surface of the core and the raised laces features and then applying additional coating material to the raised laces features.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object.

Figure 1:
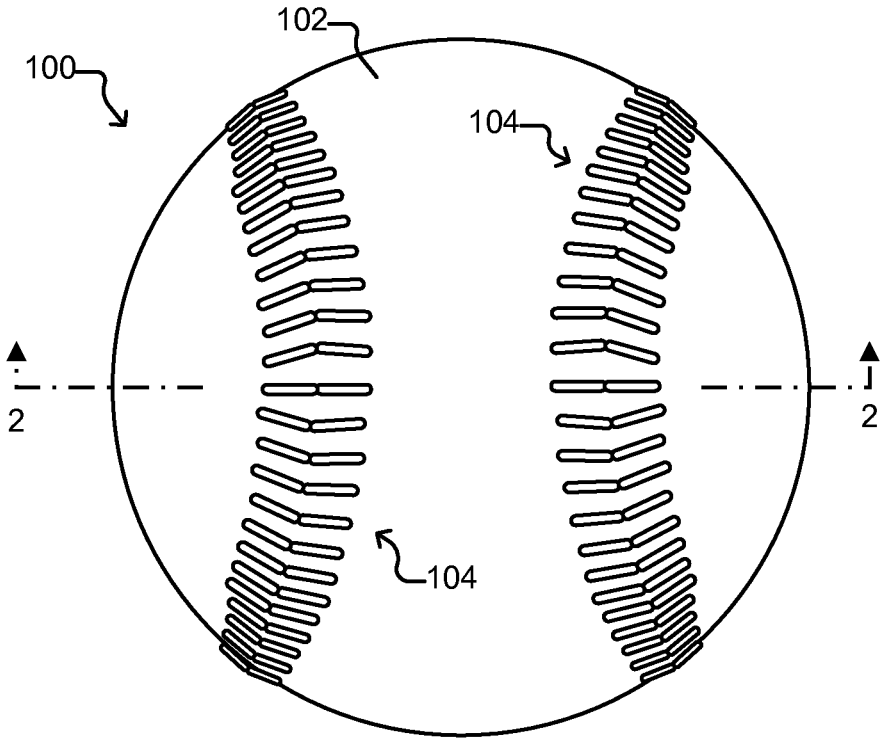
FIG. 1 illustrates a side view of a practice ball according to some embodiments of the invention.
Figure 2:
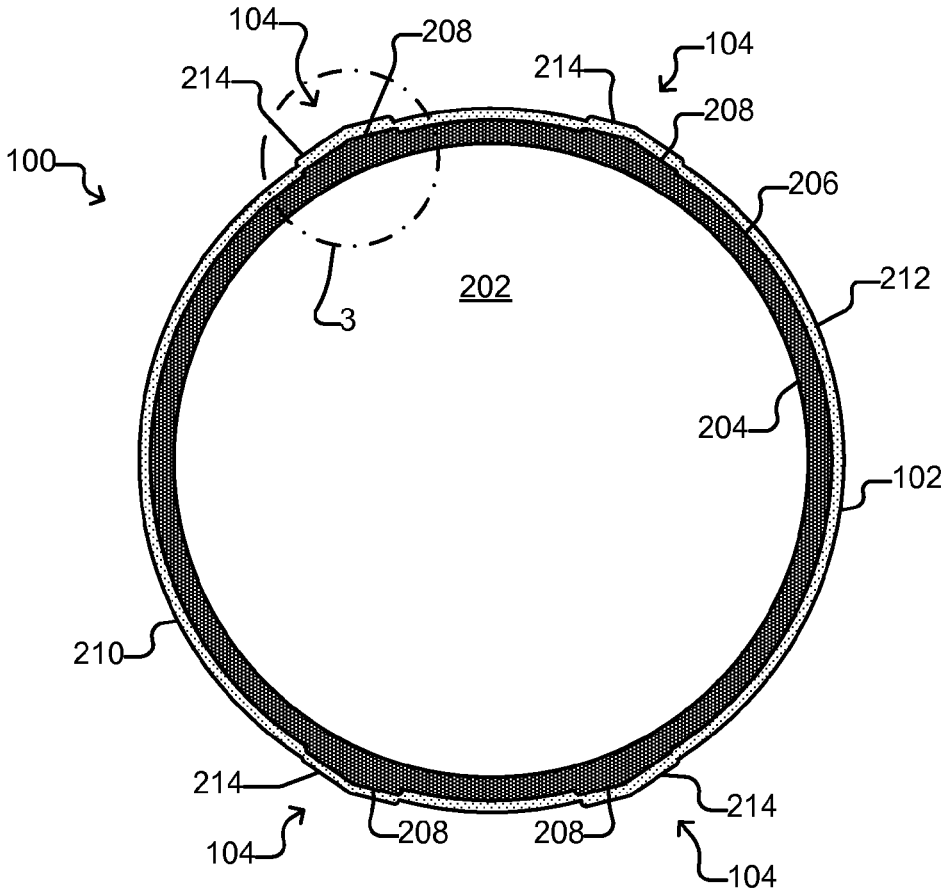
FIG. 2 illustrates a cross-sectional side view of the practice ball of FIG. 1.
Figure 3:
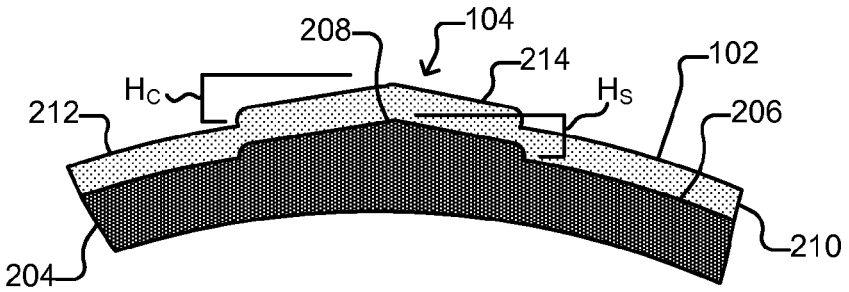
FIG. 3 illustrates a partial view from FIG. 2.

FIGS. 1-3 illustrate an example of a practice ball 100 according to some embodiments of the invention. As shown, the practice ball 100 can have raised laces features 104 that simulate laces on a game ball such as a baseball or softball. The practice ball 100 can thus be a practice baseball in some embodiments, a practice softball in other embodiments, or another type of practice ball that simulates a game ball with laces. In still other embodiments, practice ball 100 can simulate a ball without laces such as a golf ball. Hereinafter, the practice ball 100 will be described as a practice baseball, but practice ball 100 can be sized, shaped, and/or weighted differently to be another type of practice ball such as a practice softball, other types of balls with laces, or other types of balls without laces (e.g., a golf ball).

As shown in FIG. 1 (which shows a side view of the practice ball 100), the practice ball 100 can be in the shape of and generally sized like a baseball and can have a pattern of raised laces features 104 that extend form a surface 102 of the ball 100 and correspond generally to a pattern of the laces on a baseball. For example, as is known, the laces of a baseball are in a continuous pattern that stitch together two pieces of covering that form the outside of a baseball. That pattern of laces crosses two times a first line around the circumference of the baseball, and the pattern of laces crosses four times a second line around the circumference of the baseball, where the first line is in a first plane and the second line is in a second plane that is perpendicular to the first plane. In some embodiments, the raised laces features 104 of the practice ball 100 can be in the same or similar pattern. That is, the raised laces features 104 of the practice ball 100 (as well as the raised laces features 208 of the core 204 to be discussed below) can be in a continuous pattern that divides the surface 102 into two portions. Moreover, the continuous pattern of the raised laces features 104 (and the raised laces features 208) can cross twice an imaginary first line around the circumference of the practice ball 100 and cross four times an imaginary second line around the circumference of the practice ball 100, wherein the first line and the second line are in perpendicular planes. For example, the imaginary first line can be in a plane that is horizontal and in-and-out of the page of FIG. 1, and the imaginary second line can be in plane that is vertical and in-and-out of the page of FIG. 1.

As shown in FIG. 3, the raised laces features 104 can extend a height $H_C$ from the surface 102 of the practice ball 100. Alternatively, at least a desired percentage of the raised laces features 104 can extend the height $H_C$ from the surface 102 of the practice ball 100. That percentage can be, for example, at least fifty percent (50%), at least seventy-five percent (75%), or at least 90 percent (90%). That the raised laces features 104 extend height $H_C$ can cause the practice ball to fly, for example, when thrown or hit, more like a real baseball than a practice ball that lacks such raised laces features. Examples of numerical ranges for height $H_C$ are discussed below.

As shown in FIG. 2 (which shows a side, cross-sectional view of the practice ball 100), the practice ball 100 can comprise a core 204 and a coating 210 on the core 204.

In some embodiments, the core 204 can be a spherical structure with a solid outer surface 206 that encloses a hollow interior space 202. Raised laces features 208 can extend from the outer surface 206 of the core 204. As discussed above with respect to raised laces features 104, the laces features 208 can be in a pattern like the pattern of laces on a baseball as described above. The raised laces features 208 can thus be in the same or similar pattern as the raised laces features 104 as described above.

As shown in FIG. 3 (which shows a partial view from FIG. 2 as indicated by the dashed circle labeled 3 in FIG. 2), the laces features 208 can extend a height $H_S$ from the surface 206 of the core 204. In some embodiments, height $H_S$ can be in a range between one sixty-fourth (1/64) of an inch and one fourth (1/4) of an inch. Another example of a suitable range for height $H_S$ includes one sixty-fourth (1/64) of an inch to one eighth (1/8) of an inch. In other embodiments, however, the height $H_S$ can be less than one sixty-fourth (1/64) of an inch or more than one forth (1/4) of an inch.

Examples of minimum dimensions of height $H_S$ include the following. In some embodiments, the height $H_S$ can be at least one-hundred and twenty-eighth (1/128) of an inch; in other embodiments, the height $H_S$ can be at least one sixty-fourth (1/64) of an inch; in still other embodiments, the height $H_S$ can be at least one thirty-second (1/32) of an inch; in yet other embodiments, the height $H_S$ can be at least one sixteenth (1/16) of an inch; and in other embodiments, the height $H_S$ can be at least one eighth (1/8) of an inch. Nevertheless, in some embodiments the height $H_S$ can be less than one-hundred and twenty-eighth (1/128) of an inch or more than one eighth (1/8) of an inch.

As mentioned, the core 204 can be generally spherical and can be generally the size of a baseball. For example, in some embodiments, the core 204 can be two and three quarters (2 3/4) inches to three (3) inches in diameter or nine (9) inches to nine and one quarter (9 1/4) inches in circumference. In other examples, however, the diameter of the core 204 can be smaller than two and three quarters (2 3/4) inches or larger than three (3) inches and/or the circumference can be smaller than nine (9) inches or larger than nine and one quarter (9 1/4) inches. For example, in some embodiments, the circumference of the ball can be eight (8) inches to ten (10) inches.

A thickness of the core 204 can be one sixty-fourth (1/64) of an inch to one half (1/2) of an inch. Other examples of suitable ranges for the thickness of the core 204 include one sixty-fourth (1/64) of an inch to one fourth (1/4) of an inch or one eighth (1/8) of an inch, and one thirty-second (1/32) of an inch to one fourth (1/4) of an inch or one eighth (1/8) of an inch. In other embodiments, however, the thickness of the core 204 can be less than one sixty-fourth (1/64) of an inch or more than one half (1/2) of an inch.

Examples of minimum dimensions of the thickness of the core 204 include the following. In some embodiments, the thickness of the core 204 can be at least one-hundred and twenty-eighth (1/128) of an inch; in other embodiments, the thickness of the core 204 can be at least one sixty-fourth (1/64) of an inch; in still other embodiments, the thickness of the core 204 can be at least one thirty-second (1/32) of an inch; in yet other embodiments, the thickness of the core 204 can be at least one sixteenth (1/16) of an inch; and in other embodiments, the thickness of the core 204 can be at least one eighth (1/8) of an inch. Nevertheless, in some embodiments, the thickness of the core 204 can be less than one-hundred and twenty-eighth (1/128) of an inch or more than one eighth (1/8) of an inch.

The weight of the core 204 can be one third (1/3) of an ounce to two-thirds (2/3) of an ounce. Another example of a suitable range for the weight of the core 204 can be four tenths (4/10) of an ounce to six tenths (6/10) of an ounce. In other embodiments, however, the weight of the core 204 can be less than one third (1/3) of an ounce or more than two-thirds (2/3) of an ounce.

The core 204 can comprise a hard plastic material. For example, the plastic material can be sufficiently hard to withstand repeated strikes by a wooden or aluminum baseball bat without suffering appreciable, permanent deformation. Examples of suitable materials include hard plastics. For example, the core 204 can comprise a wiffle (e.g., a plastic wiffle) baseball such as is available from providers of sporting goods such as Easton-Bell Sports, Inc.

In some embodiments, the coating 210 can be a generally continuous coating covering all or substantially all of the surface 206 of the core 204. As shown in FIGS. 2 and 3, a portion 214 of the coating 210 can cover all or part of the raised laces features 208 of the core 204. The raised laces features 104 of the practice ball 100 can thus be essentially the portion 214 of the coating 210 on the raised laces features 208 of the core 204. Alternatively, the thickness of the coating 210 can be less than the height $H_S$ of the raised laces features 208 of the core 204, and the height of the raised laces features 104 from the surface 102 of the practice ball 100 can thus be greater than the thickness of the portion 214 of the coating 210 on the raised laces features 208.

As shown in FIG. 3, the portion 214 of the coating 210 on the raised laces features 208 of the core 204 can extend a height $H_C$ from the surface 212 of the coating 210 (which can also be the surface 102 of the practice ball 100). In some embodiments, height $H_C$ can be in a range between one sixty-fourth (1/64) of an inch and one fourth (1/4) of an inch. Another example of a suitable range for height $H_C$ is one sixty-fourth (1/64) of an inch to one eighth (1/8) of an inch. In other embodiments, however, the height $H_C$ can be less than one sixty-fourth (1/64) of an inch or more than one forth (1/4) of an inch.

Examples of minimum dimensions of height $H_C$ include the following. In some embodiments, the height $H_C$ can be at least one-hundred and twenty-eighth (1/128) of an inch; in other embodiments, the height $H_C$ can be at least one sixty-fourth (1/64) of an inch; in still other embodiments, the height $H_C$ can be at least one thirty-second (1/32) of an inch; in yet other embodiments, the height $H_C$ can be at least one sixteenth (1/16) of an inch; and in other embodiments, the height $H_C$ can be at least one eighth (1/8) of an inch. Nevertheless, in some embodiments the height $H_C$ can be less than one-hundred and twenty-eighth (1/128) of an inch or more than one eighth (1/8) of an inch.

Because the surface of the coating 212 can correspond to the surface 102 of the practice ball 100 and the portion 214 of the coating 210 on the raised laces features 208 of the core 204 can thus correspond to the raised laces features 104 of the practice ball 100, the height $H_C$ can be the same or substantially the same as the height the raised laces features 104 of the practice ball 100 extend from the surface 102 of the practice ball 100. As noted above, however, the thickness of the coating 210 can be less than the height $H_S$ of the raised laces features 208 of the core 204, and the height of the raised laces features 104 from the surface 102 of the practice ball 100 can thus be greater than the thickness of the portion 214 of the coating 210 on the raised laces features 208.

The thickness of the coating 102 can be generally uniform. Alternatively, the thickness of the portion 214 of the coating 210 on the raised laces features 208 of the core 204 can be a different thickness (e.g., thicker or thinner) than the thickness of the portions of the coating 210 that are not on the raised laces features 208 of the core 204. Regardless, the thickness of at least the portions of the coating 210 that are not on the raised laces features 208 can be one sixty-fourth (1/64) of an inch to one fourth (¼) of an inch. In other embodiments, a thickness of the coating 210 can be one sixteenth (1/16) of an inch to one eighth (⅛) of an inch, and in still other embodiments, the thickness of the coating 210 can be smaller than one sixty-fourth (1/64) of an inch or larger than one fourth (¼) of an inch.

Examples of minimum dimensions of the thickness of at least the portions of the coating 210 that are not on the raised laces features 208 include the following. In some embodiments, that thickness can be at least one-hundred and twenty-eighth (1/128) of an inch; in other embodiments, that thickness can be at least one sixty-fourth (1/64) of an inch; in still other embodiments, that thickness can be at least one thirty-second (1/32) of an inch; in yet other embodiments, that thickness can be at least one sixteenth (1/16) of an inch; and in other embodiments, that thickness can be at least one eighth (⅛) of an inch. Nevertheless, in some embodiments, that thickness can be less than one-hundred and twenty-eighth (1/128) of an inch or more than one eighth (⅛) of an inch.

The weight of the coating 210 can be between one-half and four times the weight of the core 204 in some embodiments. In other embodiments, the weight of the coating 210 can be between one and three times the weight of the core 204. In still other embodiments, the weight of the coating 210 can be between one and two times the weight of the core 204. In yet other embodiments, however, the weight of the coating 210 can be outside of any of the foregoing weight ranges.

In some embodiments, the weight of the coating 210 can be at least one fourth (¼) the weight of the core 204, at least one half (½) the weight of the core 204, at least equal to the weight of the core 204, at least one and a half (1.5) times the weight of the core 204, or at least two (2) times the weight of the core. In other embodiments, the weight of the coating 210 can be less than one fourth (¼) the weight of the core.

In some embodiments, the weight of the coating 210 can be between one quarter (¼) an ounce and two (2) ounces. In other embodiments, the weight of the coating 210 can be between one half (½) of an ounce and one and a half (1½) ounces. In still other embodiments, the weight of the coating 210 can be between one half (½) of an ounce and one (1) ounce. In yet other embodiments, however, the weight of the coating can be outside of any of the foregoing weight ranges.

In some embodiments, the weight of the coating 210 can be at least one half (½) an ounce, at least one (1) ounce, or at least one and a half (1.5) ounces. In other embodiments, the weight of the coating 210 can be less than one half (½) an ounce.

Regardless of the dimensions and/or weight of the coating 210, the coating 210 can comprise one or more layers. Thus, for example, the coating 210 can comprise one or more layers of coatings.

Whether one layer or more than one layer, the coating 210 can comprise material or materials that are sufficiently durable to withstand repeated strikes by a wooden or aluminum baseball bat without suffering appreciable, permanent deformation. In some embodiments, the coating 210 can comprise material that is resistant to transfer to objects with which the practice ball 100 may come into contact. For example, the material of the coating 210 can be resistant to transfer to a baseball bat that strikes the ball 100, the walls or a floor of an indoor gym or other practice facility, or the like. Examples of suitable materials of the coating 210 include without limitation synthetic rubbers, plastic-based materials, elastomeric materials, rubberized materials, or the like. One non-limiting example of a suitable material of coating 210 is a synthetic rubber coating available under the trade name Plasti Dip® from Plasti Dip International of Blaine Minn.

The practice ball 100 illustrated in FIGS. 1-3 is an example, and variations are possible. As an example of one such variation, as mentioned, the practice ball 100 can be a softball. Practice ball 100 can be sized to correspond to a softball, and the examples of dimensions and weightings of the core 204 and coating 210 described above with respect to a practice baseball can be increased or otherwise modified in accordance with the general difference between the size and weight of a baseball and a softball. As another example of such a variation, the practice ball 100 can simulate other types of balls such as a golf ball. As yet another example, additional material can be applied to the ball 100. For example, a sealing material (not shown) can be applied to the surface 102 of the ball 100.

Figure 4:
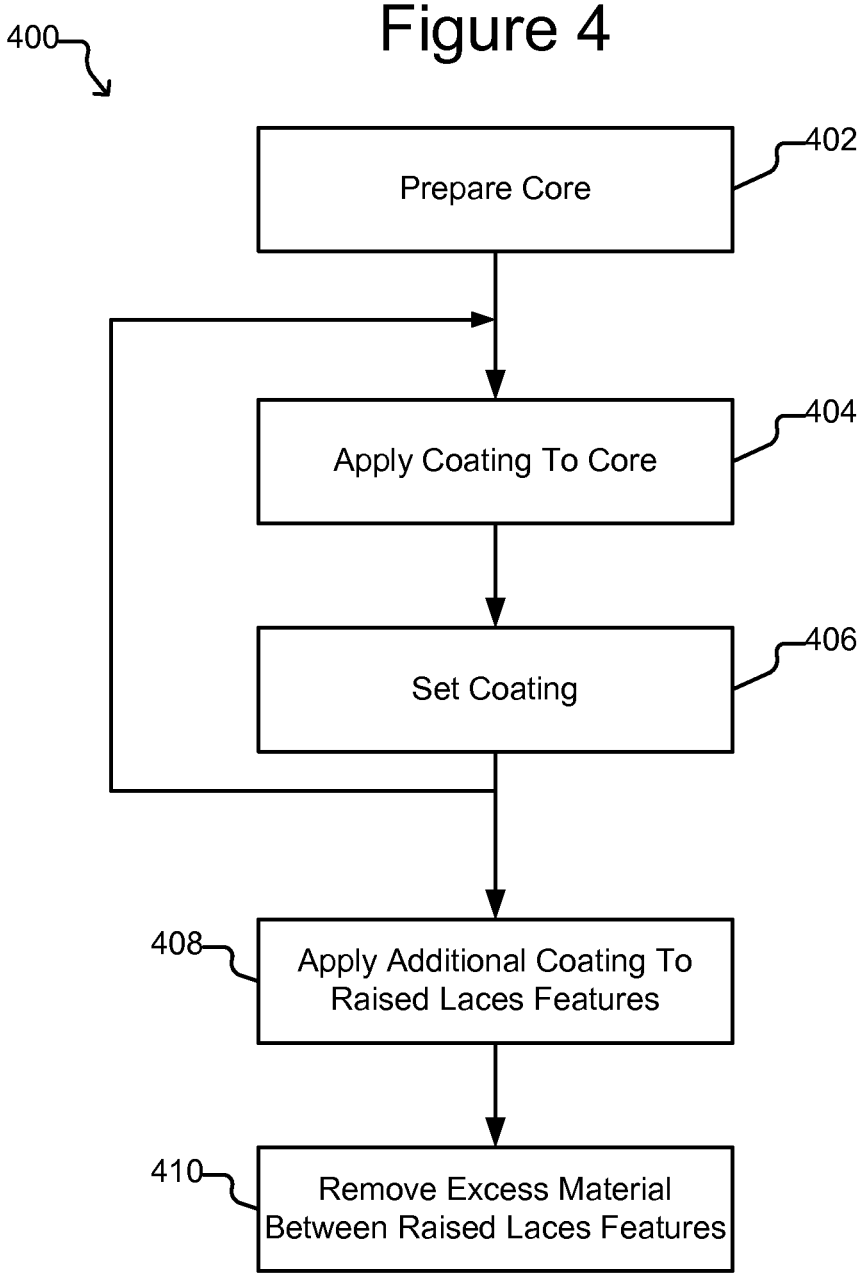
FIG. 4 illustrates an example of a process for making the practice ball of FIG. 1 according to some embodiments of the invention.

FIG. 4 illustrates an example of a process 400 for making a practice ball like the practice ball 100 of FIGS. 1-3 according to some embodiments of the invention. Although process 400 can be used to make practice balls other than ball 100, for ease of illustration and description, an example of process 400 is described herein for making the practice ball 100.

As shown in FIG. 4, a core can be prepared at step 402. For example, core 204 can be prepared at step 402. Examples of ways in which the core 204 can be prepared at step 402 include washing the core 204 and/or treating the core 204 to enhance adhesion of coating 210 to the core 204. For example, the surface 206 of the core 204 can be roughened.

At step 404, a coating can be applied to the core 204. For example, material of coating 210 can be applied to the core at step 404. In some embodiments, the material of coating 210 can be in liquid form, and the core 204 can be immersed in the liquid at step 404. In other embodiments, the material of coating 210 can be applied to the core in other ways such as spraying, brushing, or the like the material of coating 210 onto the core 204. The material of the coating 210 can be any of the types of material discussed above with respect to coating 210.

At step 406, the material of the coating 210 can be allowed to set (e.g., dry, harden, or the like) as needed. For example, the core 204 can be allowed to hang-dry for a given time period.

As shown in FIG. 4, the process 400 can repeat the steps 404 of applying the material of coating 210 and 406 of allowing the material to set one or more times. In some embodiments, the orientation of the core 204 can be changed each time the material of the coating is applied at step 404 and/or the material is allowed to set at step 406. This can facilitate uniform coating of the core 204. Each time step 404 is repeated the same or a different coating material can be applied.

The steps 404 and 406 can be repeated as many times as desired. For example, the steps 404 and 406 can be repeated until coating 210 is a desired thickness or weight, for example, as discussed above with respect to the coating 210. Alternatively, steps 404 and 406 need not be repeated.

As shown in FIG. 4, at step 408, the material of the coating 210 can be further applied to the raised laces features 208 of the core 204 or to the portions 214 of the coating 210 already on the raised laces features 208 of the core 204. For example, the material of the coating 210 can be sprayed, brushed, or otherwise applied to the raised laces features 208 or previous portions 214 of the coating 210 at step 408. The material of the coating 210 applied at step 408 can be any of the materials discussed above with respect to the coating 210 and can be the same or different than the material of the coating 210 applied at step 404.

Although not shown, the material of the coating 210 applied at step 408 can be allowed to set. Step 408 can be repeated as desired, for example, until the portion 214 of the coating 210 on the raised laces features 208 of the core 204 extend a desired height (e.g., $H_C$ in FIG. 3) from the surface 212 of the coating 210. Moreover, if step 408 is repeated, the same or a different material of the coating 210 can be applied at step 408.

To further enhance the height $H_C$ material of the coating 210 (e.g., excess material) can be removed from between the laces features 208 and/or the portion 214 of the coating 210 on the laces features 208 at step 410. Step 410 can also be repeated as desired, and can be performed before or after step 408.

The process 400 illustrated in FIG. 4 is an example, and variations are possible. As an example of a variation of process 400, the steps 402-410 need not be performed in the order shown. For example, step 410 can be performed between steps 404 and 406 and/or after step 406. As another example of a variation of process 400, all of the steps 402-410 need not be performed. For example, steps 408 and 410 need not be performed. As another example, the core need not be prepared at step 402. As yet another example of a variation of process 400, additional steps can be performed. For example, the raised laces features 104 can be colored after step 410, and/or designs, lettering, logos, or the like can be applied to the surface 102 of the practice ball 102 after step 410. As another example, additional material can be applied to the ball 100. For example, as previously mentioned, a sealing material (not shown) can be applied to the surface 102 of the ball 100.

Although specific embodiments and applications of the invention have been described in this specification, these embodiments and applications are exemplary only, and many variations are possible.

I claim:

1. A process of make a practice ball, said process comprising:

obtaining a plastic substantially spherical core comprising a solid continuous outer surface, a hollow interior, and raised laces features disposed on and extending from said outer surface;

applying a uniform coating of a synthetic rubber material to said outer surface of said core and said raised laces features; and applying additional material only to said raised laces features so that said additional material is thicker than said uniform synthetic rubber material.

2. The process of claim 1 further comprising, after said step of applying said additional material only to said raised laces features, removing portions of said additional material from between adjacent ones of said raised laces features without removing portions of said uniform coating.

3. The process of claim 1, wherein said raised laces features are disposed on said outer surface of said core in a continuous pattern that divides said outer surface into two portions, wherein said continuous pattern crosses twice a first circumference of said core and crosses four times a second circumference of said core, wherein said first circumference is in a first plane and said second circumference is in a second plane that is perpendicular to said first plane.

4. The process of claim 1, wherein said step of apply said coating of said synthetic rubber material comprises immersing said core in a liquid form of said synthetic rubber material.

5. The process of claim 4, wherein said step of applying said additional material only to said raised laces features comprises applying said additional material directly only to said raised laces features without immersing said core in said liquid form of said synthetic rubber material.

6. The process of claim 1, wherein a diameter of said core is between two and three quarters and three inches.

7. The process of claim 1, wherein said additional material is said synthetic rubber material.

8. The process of claim 1, wherein a combined weight of said synthetic rubber material applied to said core and a weight of said additional material applied only to said laces features is at least one fourth a weight of said core.

9. The process of claim 1, wherein a combined weight of said synthetic rubber material applied to said core and a weight of said additional material applied only to said laces features is greater than a weight of said core.

10. The process of claim 1, wherein a combined weight of said synthetic rubber material applied to said core and a weight of said additional material applied only to said laces features is between one half and four times a weight of said core.

11. The process of claim 1, wherein a combined weight of said synthetic rubber material applied to said core and a weight of said additional material applied only to said laces features is between one and three times a weight of said core.

12. The process of claim 1, wherein a combined weight of said synthetic rubber material applied to said core and a weight of said additional material applied only to said laces features is between one and two times a weight of said core.

13. The process of claim 1, wherein a weight of said synthetic rubber material applied to said core is at least one fourth a weight of said core.

14. The process of claim 1, wherein a weight of said synthetic rubber material applied to said core is greater than a weight of said core.

15. The process of claim 1, wherein a weight of said synthetic rubber material applied to said core is at least two times a weight of said core.

16. The process of claim 1, wherein a weight of said synthetic rubber material applied to said core is between one half and four times a weight of said core.

17. The process of claim 1, wherein a weight of said synthetic rubber material applied to said core is between one and three times a weight of said core.

18. The process of claim 1, wherein a weight of said synthetic rubber material applied to said core is between one and two times a weight of said core.

* * * * *